US010065415B2

(12) United States Patent
Nitta et al.

(10) Patent No.: US 10,065,415 B2
(45) Date of Patent: Sep. 4, 2018

(54) CORRECTION DATA SETTING APPARATUS AND INKJET HEAD

(71) Applicant: TOSHIBA TEC KABUSHIKI KAISHA, Shinagawa-ku, Tokyo (JP)

(72) Inventors: Noboru Nitta, Shizuoka (JP); Teruyuki Hiyoshi, Shizuoka (JP); Shunichi Ono, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/877,448

(22) Filed: Jan. 23, 2018

(65) Prior Publication Data

US 2018/0141330 A1 May 24, 2018

Related U.S. Application Data

(63) Continuation of application No. 15/384,491, filed on Dec. 20, 2016, now Pat. No. 9,908,325.

(30) Foreign Application Priority Data

Jan. 15, 2016 (JP) ..... 2016-006615

(51) Int. Cl.
*B41J 2/045* (2006.01)

(52) U.S. Cl.
CPC ..... *B41J 2/04508* (2013.01); *B41J 2/04541* (2013.01); *B41J 2/04545* (2013.01);
(Continued)

(58) Field of Classification Search
None
See application file for complete search history.

(56) References Cited

U.S. PATENT DOCUMENTS 6,572,212 B2 * 6/2003 Konno ..... B41J 2/04506 347/14
9,302,475 B2 4/2016 Nitta et al.
(Continued)

FOREIGN PATENT DOCUMENTS

JP 2012-045780 3/2012
JP 2013-059961 4/2013
(Continued)

OTHER PUBLICATIONS

IP.com search.*
The query text from IP.com.

*Primary Examiner* — Lisa M Solomon
(74) *Attorney, Agent, or Firm* — Amin, Turocy & Watson LLP

(57) ABSTRACT

A first output section outputs a first parameter calculated for each nozzle in a group obtained by dividing the nozzles into groups for each certain number so that density unevenness of ink ejected from each nozzle in the group is corrected. A second output section outputs a second parameter calculated for each group so that change rate of the density unevenness between groups is corrected. A first register circuit divides first parameters for each nozzle in the group and stores the first parameters. A second register circuit divides second parameters for each group and stores the second parameters. A multiplication section sequentially multiplies the first parameters by the second parameters. A conversion section converts a multiplication value to correction data of each nozzle. A setting section sets the correction data in a memory.

5 Claims, 14 Drawing Sheets

(52) U.S. Cl.
CPC ..... *B41J 2/04581* (2013.01); *B41J 2/04591* (2013.01); *B41J 2/04595* (2013.01)

(56) References Cited

U.S. PATENT DOCUMENTS

| | | | |
|---|---|---|---|
| 2009/0015615 | A1 | 1/2009 | Miyamoto |
| 2016/0039199 | A1 | 2/2016 | Hiyoshi et al. |
| 2016/0121606 | A1 | 5/2016 | Kimura et al. |
| 2016/0167378 | A1 | 6/2016 | Kimura et al. |

FOREIGN PATENT DOCUMENTS

| | | | | |
|---|---|---|---|---|
| JP | 2013176891 | A | * | 9/2013 |
| JP | 2016-055513 | | | 4/2016 |

* cited by examiner

| CHANNEL NO. | CORRECTION TIME t |
|---|---|
| 1 | t01 |
| 2 | t02 |
| 3 | t03 |
| 4 | t04 |
| ⋮ | ⋮ |
| 320 | t0n |

CORRECTION DATA SETTING APPARATUS AND INKJET HEAD

CROSS-REFERENCE TO RELATED APPLICATIONS

This application is a Continuation of application Ser. No. 15/384,491 filed on Dec. 20, 2016, the entire contents of which are incorporated herein by reference.

This application is based upon and claims the benefit of priority from Japanese Patent Application No. P2016-006615, filed Jan. 15, 2016, the entire contents of which are incorporated herein by reference.

FIELD

Embodiments described herein relate generally to a setting apparatus of correction data relating to density correction of an inkjet head and an inkjet head which carries out printing with the correction data set by the setting apparatus.

BACKGROUND

In an inkjet head formed by arranging a plurality of nozzles for ejecting ink droplets in one direction, the volume of ink droplets ejected from the nozzle is not always uniform. Thus, density unevenness occasionally occurs even if the same number of ink droplets is ejected from each nozzle to print a solid image. In a case in which printing is carried out in a printing area wider than a width of a nozzle arrangement direction of the inkjet head, the printing area is divided in a width direction and a plurality of the inkjet heads is arranged for each divided area to carry out the printing in some cases. In such a case, a level difference in density occurs at a boundary between the heads.

The main reason why the volume of the ink droplets ejected from each nozzle is not uniform is the occurrence of dispersion in the configuration of the inkjet head. For example, the diameter of each nozzle or the volume of a pressure chamber communicating with each nozzle is not necessarily certain. Such dispersion in the configuration is always caused by characteristics of a processing machine used at the time of manufacturing the inkjet head.

Conventionally, there is a technology which adjusts an ejection amount of the ink droplet for every nozzle by correcting a pulse width of a drive pulse signal applied to each actuator respectively corresponding to each nozzle. With the technology, it is possible to make uniform an amount of the ink droplet ejected from each nozzle. However, in order to make uniform the amount, correction data for correcting the pulse width for each nozzle must be calculated. For example, 320 pieces of the correction data must be calculated for an inkjet head which has 320 nozzles, which takes too much time and labor.

DETAILED DESCRIPTION

Figure 1:
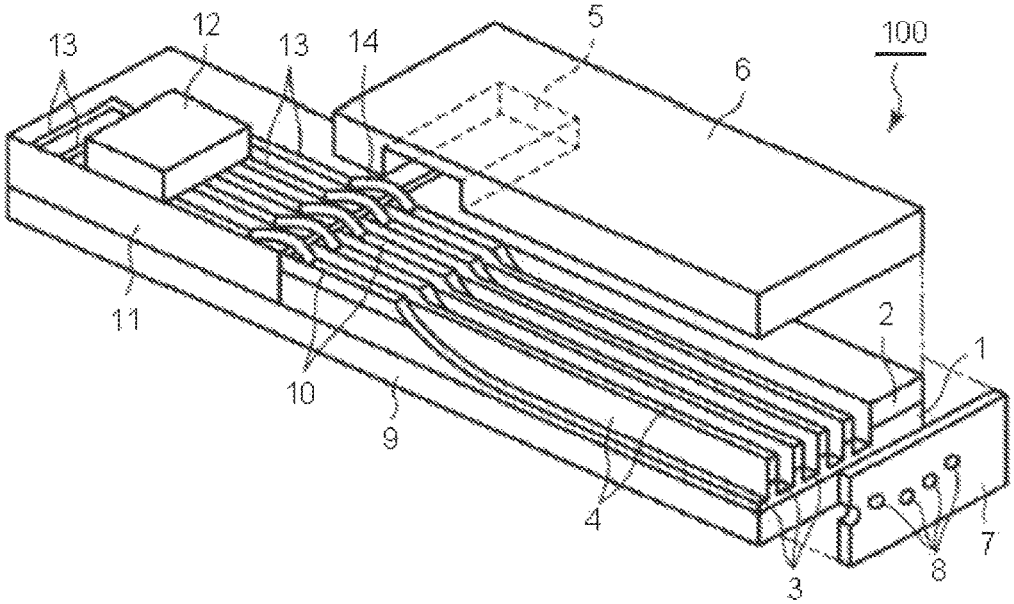
FIG. 1 is an exploded perspective view illustrating a part of an inkjet head according to an embodiment.

In accordance with an embodiment, a correction data setting apparatus sets correction data in a memory which stores correction data of each nozzle for correcting a pulse width of a drive pulse signal applied to each actuator respectively corresponding to each nozzle of an inkjet head formed by arranging a plurality of the nozzles for ejecting ink. The correction data setting apparatus comprises a first output section, a second output section, a first register circuit, a second register circuit, a multiplication section, a conversion section and a setting section. The first output section outputs a first parameter calculated for each nozzle in a group obtained by dividing the nozzles into groups for each certain number so that density unevenness of the ink ejected from each nozzle in the group is corrected. The second output section outputs a second parameter calculated for each group so that change rate of the density unevenness between groups is corrected. The first register circuit divides the first parameters output from the first output section for each nozzle in the group and stores the first parameters. The second register circuit divides the second parameters output from the second output section for each group and stores the second parameters. The multiplication section sequentially multiplies the first parameters of each nozzle stored in the first register circuit by the second parameters of each group stored in the second register circuit. The conversion section converts a multiplication value calculated by the multiplication section in units of groups to the correction data of each nozzle. The setting section sets the correction data obtained by the conversion section in the memory.

In accordance with another embodiment, a correction data setting method which sets correction data in a memory storing correction data of each nozzle for correcting a pulse width of a drive pulse signal applied to each actuator corresponding to each nozzle of an inkjet head involves outputting a first parameter calculated for each nozzle in a group obtained by dividing the nozzles into groups for each certain number for correcting density unevenness of the ink ejected from each nozzle in the group; outputting a second parameter calculated for each group for correcting change rate of the density unevenness between groups; dividing the first parameters output for each nozzle in the group and storing the first parameters; dividing the second parameters for each group and storing the second parameters; sequentially multiplying the first parameters of each nozzle stored by the second parameters of each group stored; converting a multiplication value calculated in units of a group to the correction data of each nozzle; and setting the correction data obtained.

Hereinafter, embodiments of a setting apparatus of correction data for an inkjet head and an inkjet printer which carries out printing with the correction data set in a memory through the setting apparatus are described with reference to the accompanying drawings. In the embodiment, a share mode type inkjet head 100 (refer to FIG. 1) is exemplified as the inkjet printer.

First Embodiment

Figure 2:
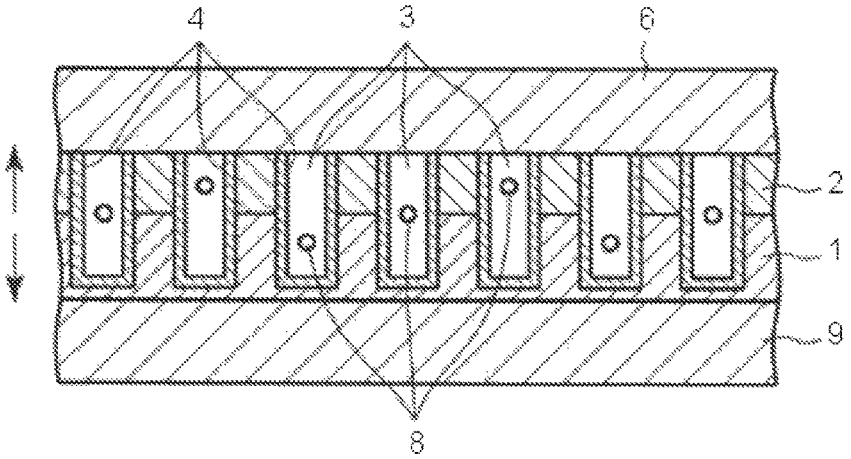
FIG. 2 is a cross-section view illustrating a front part of the inkjet head.
Figure 3:
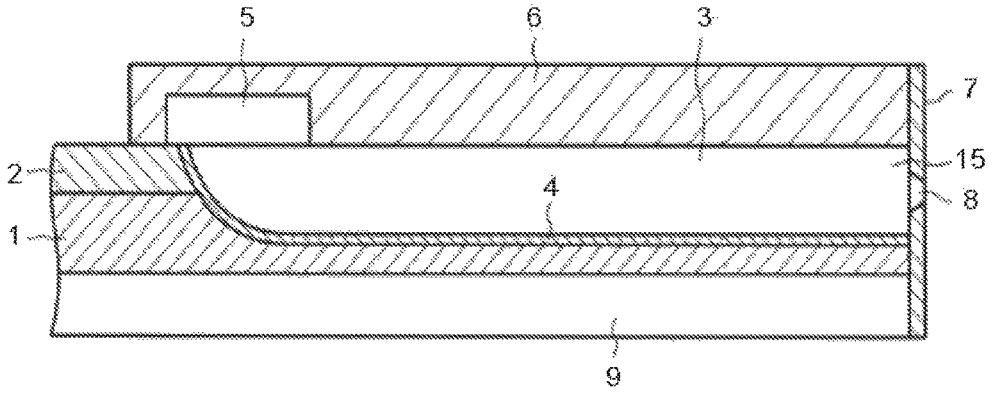
FIG. 3 is a longitudinal section view illustrating the front part of the inkjet head.

First, the constitution of the inkjet head 100 (hereinafter, referred to as a head 100 for short) is described with reference to FIG. 1~FIG. 3. FIG. 1 is an exploded perspective view illustrating a part of the head 100, FIG. 2 is a cross-section view illustrating the front part of the head 100, and FIG. 3 is a longitudinal section view illustrating the front part of the head 100. Further, for the head 100, the longitudinal direction set as the vertical direction, and the direction perpendicular to the longitudinal direction is the transverse direction.

The head 100 is equipped with a rectangular base substrate 9. The head 100 bonds a first piezoelectric member 1 to the upper surface at the front side of the base substrate 9 and bonds a second piezoelectric member 2 on the first piezoelectric member 1. The bonded first piezoelectric member 1 and second piezoelectric member 2 are polarized in the mutually opposite directions along the thickness direction of the base substrate 9 as shown by arrows of FIG. 2.

The base substrate 9 is made from a material which has a small dielectric constant and of which the difference in thermal expansion coefficient from the piezoelectric members 1 and 2 is small. As a material of the base substrate 9, for example, alumina ($Al_2O_3$), silicon nitride ($Si_3N_4$), silicon carbide (SiC), aluminum nitride (AlN) and lead zirconic titanate (PZT) are preferable. On the other hand, as a material of the piezoelectric members 1 and 2, lead zirconic titanate (PZT), lithium niobate ($LiNbO_3$) and lithium tantalate ($LiTaO_3$) are used.

The head 100 arranges a plurality of long grooves 3 from the front end side towards the rear end side of the bonded piezoelectric members 1 and 2. The grooves 3 are arranged with a given interval successively therebetween in parallel with each other. The front end of each groove 3 is opened and the rear end thereof is inclined upwards. A cutting machine can used to form these plural grooves 3.

The head 100 arranges an electrode 4 on a side wall of each groove 3. The electrode 4 has a two-layer structure consisting of thin gold (Au) and nickel (Ni). The electrode 4 is formed uniformly in each groove 3 with a plating method. The forming method of the electrode 4 is not limited to the plating method. In addition, a sputtering method or an evaporation method can also be used.

The head 100 arranges an extraction electrode 10 from the rear end of each groove 3 towards the upper surface of the rear side of the second piezoelectric member 2. The extraction electrode 10 extends from the electrode 4.

The head 100 includes a top plate 6 and an orifice plate 7. The top plate 6 seals the upper part of each groove 3. The orifice plate 7 seals the front end of each groove 3. In the head 100, a plurality of pressure chambers 15 is formed with the grooves 3 each of which is surrounded by the top plate 6 and the orifice plate 7. The pressure chambers 15, for example, each of which has a depth of 300 μm and a width of 80 μm, are arranged in parallel at an interval of 169 μm. However, due to dispersion at the time of manufacture caused by the characteristics of the cutting machine, the shape of each pressure chamber 15 is not necessarily uniform. For example, the cutting machine collectively forms 16 pressure chambers 15 and then forms 320 pressure chambers 15 by repeating an operation described above 20 times. At this time, if individual difference occurs in cutting blades for forming 16 pressure chambers, the shape of each pressure chamber 15 has periodicity. Moreover, the shape of the pressure chamber slightly changes due to change in a processing temperature at the time of repeated processing of 20 times. The small change in these pressure chambers 15 is one of causes of the small periodic change of print density eventually.

The top plate 6 comprises a common ink chamber 5 at the rear of the inside thereof. The orifice plate 7 arranges a nozzle 8 at a position opposite to each groove 3. The nozzles 8 communicate with the grooves 3, in other words, the pressure chambers 15 facing the nozzles 8. The nozzle 8 is formed into a taper shape from the pressure chamber 15 side towards the ink ejection side of the opposite side to the pressure chamber 15 side. Three nozzles 8 corresponding to the adjacent three pressure chambers 15 are assumed as a set and are formed in a shifted manner at a given interval in the height direction (vertical direction of paper surface of FIG. 2) of the groove 3. FIG. 2 schematically illustrates the nozzle 8 to understand the position of the nozzle 8. The nozzle 8 can be formed by a laser processing machine, for example. When the laser processing machine forms the nozzle 8 at a predetermined position, as a method for determining a processing position of each nozzle 8, there is a method of optically setting the position of a laser beam and a method of mechanically moving work, i.e. the orifice plate 7 side. If there are many nozzles 8, it is convenient to mix the two methods. However, if a hole drilling combining the optical positioning method and the mechanical positioning method is executed, periodicity occurs in a hole shape due to the minute change of the hole shape in each processing. The periodicity of the hole shape also becomes one of the causes of the small periodic change of the print density.

The head 100 bonds a printed substrate 11 on which conductive patterns 13 are formed to the upper surface at the rear side of the base substrate 9. The head 100 carries a drive IC 12 in which a head drive circuit 101 (refer to FIG. 8) described later is mounted on the printed substrate 11. The drive IC 12 is connected with the conductive patterns 13. The conductive patterns 13 are bonded with each extraction electrode 10 via conducting wires 14 through a wire bonding.

One drive IC 12 may drive the electrodes corresponding to all of the nozzles 8. However, if the number of circuits per one drive IC becomes too large, some disadvantages occur. For example, a chip size becomes large and yield is greatly reduced, the wiring of an output circuit becomes difficult, heat generation is concentrated at the time of driving, or increase or decrease in the number of the drive ICs cannot correspond to increase or decrease in the number of the nozzles. For this reason, for example, for the head with 320 nozzles 8, four drive ICs 12 of which the amount of output is 80 circuits are enough to use. However, in this case, due to the difference in wiring resistance in the drive IC 12, the output waveform has a spatial period according to the arrangement direction of the nozzles 8. The strength of the periodicity varies depending on individual differences of the drive ICs 12. The spatial periodicity of the output waveform also becomes one of the causes of the small periodic change of the print density.

A set consisting of a pressure chamber 15, an electrode 4 and a nozzle 8 included in the head 100 is referred to as a channel. That is, the head 100 has channels the number of which is equal to that of the grooves 3. Incidentally, the ink is not ejected from the channels at both ends of the share mode type of the head 100. However, in the present embodiment, for convenience of description, the channel number of the channel which ejects the ink is n, and the channel numbers 1, 2, 3, . . . , n are assigned to the channels in order from one end side towards the other end side in the arrangement direction of the nozzle 8. That is, the channel at the one end side when viewing the head 100 from the front side is referred to as ch.1, and the channel adjacent thereto is referred to as ch.2. Similarly, the channel number is assigned in the same way, and the channel at the other side is referred to as ch.n.

Next, the operation principle of the head 100 constituted as described above is described with reference to FIG. 4 and FIG. 5.

Figure 4:
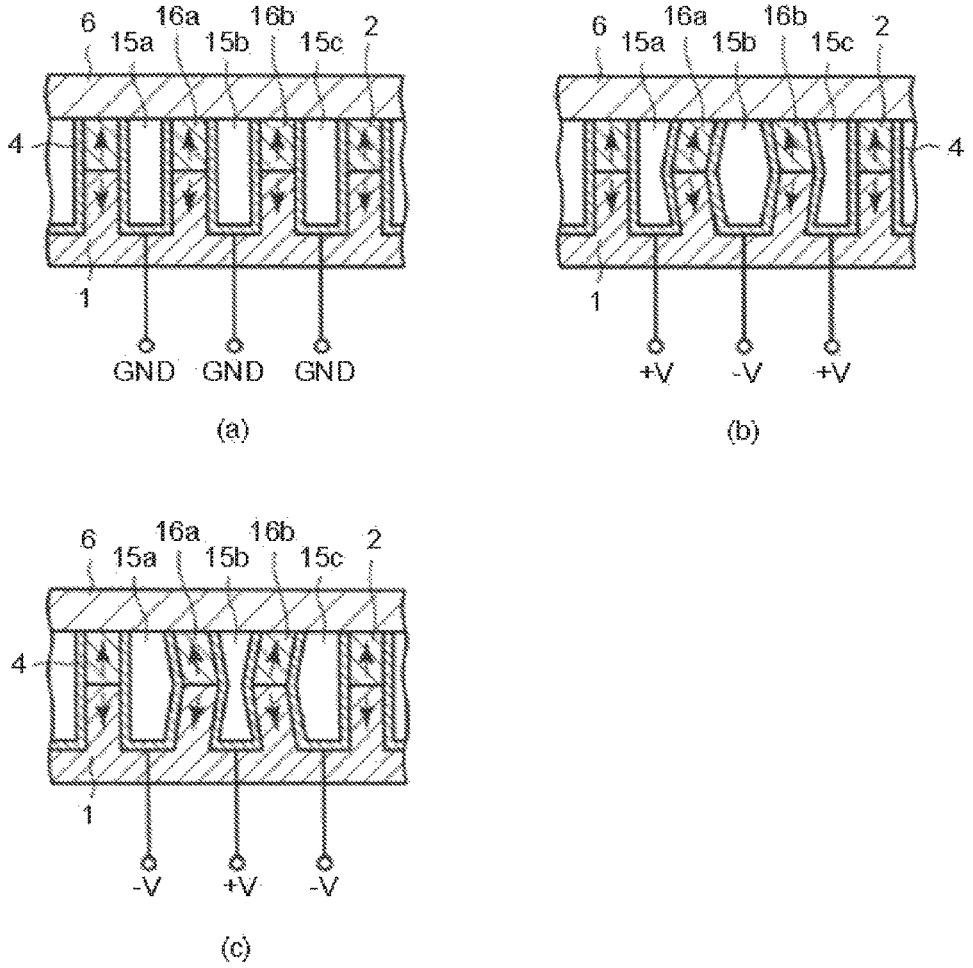
FIG. 4 is a schematic diagram illustrating an operation principle of the inkjet head.

FIG. 4(*a*) illustrates a state where the potential of each electrode 4 which is arranged on each wall surface of a pressure chamber 15*b* at the center and pressure chambers 15*a* and 15*c* adjacent to both sides of the pressure chamber 15*b* is ground potential GND. In such a state, no distortion effect acts on both a partition wall 16*a* sandwiched by the pressure chamber 15*a* and the pressure chamber 15*b* and a partition wall 16*b* sandwiched by the pressure chamber 15*b* and the pressure chamber 15*c*.

FIG. 4(*b*) illustrates a state where a voltage of −V having a negative polarity is applied to the electrode 4 of the central pressure chamber 15*b* and a voltage of +V having a positive polarity is applied to the electrodes 4 of the pressure chambers 15*a* and 15*c* adjacent to both sides of the pressure chamber 15*b*. In such a state, an electric field which is twice as large as that of the voltage of V acts on the partition walls 16*a* and 16*b* in a direction orthogonal to the polarized direction of the piezoelectric members 1 and 2. Through such an action, each of the partition walls 16*a* and 16*b* is deformed outward so that the volume of the pressure chamber 15*b* is expanded.

FIG. 4(*c*) illustrates a state where the voltage of +V having the positive polarity is applied to the electrode 4 of the central pressure chamber 15*b* and the voltage of −V having the negative polarity is applied to the electrodes 4 of the pressure chambers 15*a* and 15*c* adjacent to both sides of the pressure chamber 15*b*. In such a state, the electric field which is twice as large as that of the voltage of V acts on the partition walls 16*a* and 16*b* in a direction reverse to the direction shown in FIG. 4(*b*). Through such an action, each of the partition walls 16*a* and 16*b* is deformed inward so that the volume of the pressure chamber 15*b* is contracted.

Figure 5:
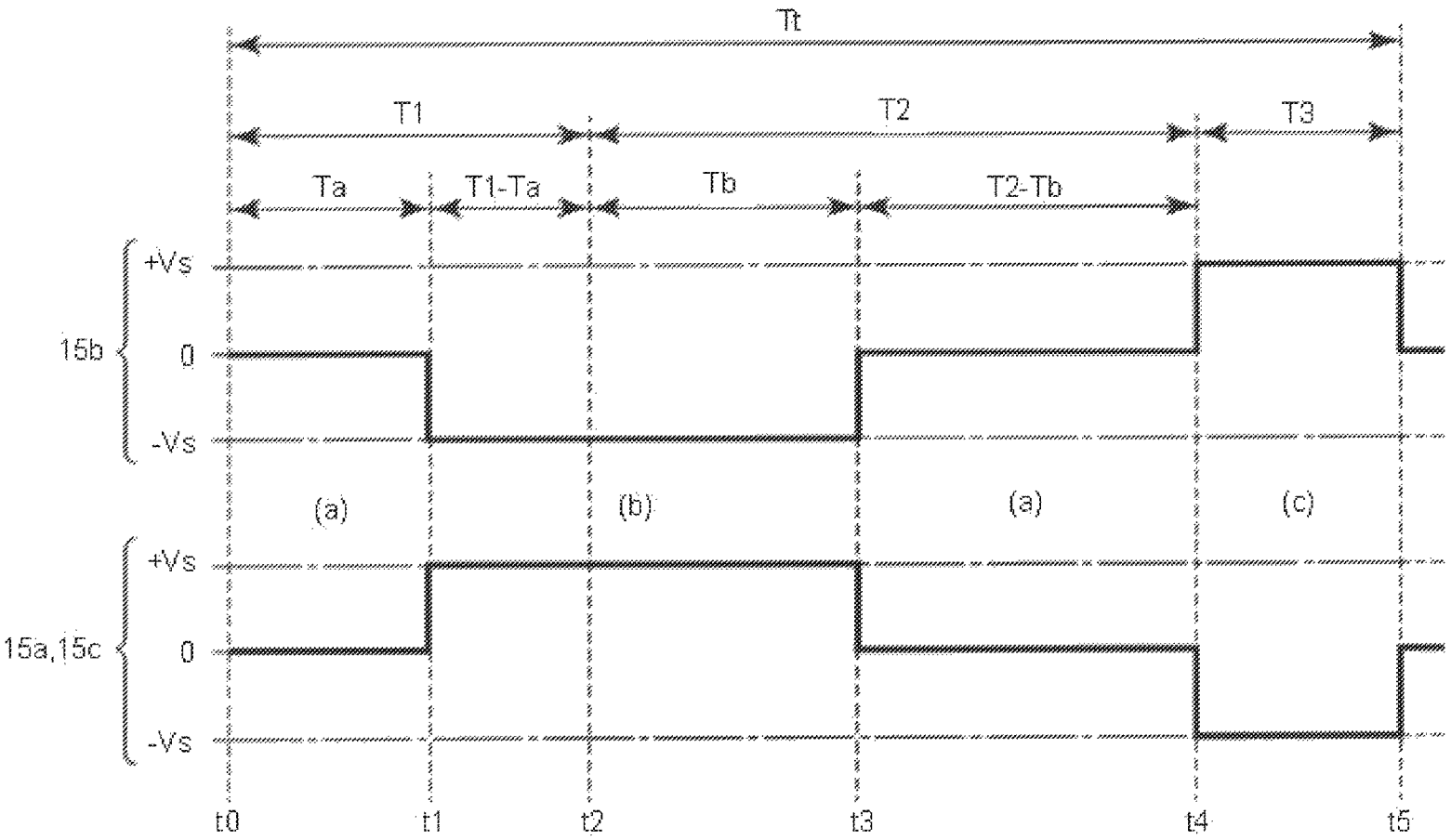
FIG. 5 is a waveform diagram illustrating a reference pulse waveform of a drive pulse signal applied to the inkjet head.

FIG. 5 illustrates reference pulse waveforms of the drive pulse signals applied to the electrodes 4 of the pressure chamber 15*b* and the pressure chambers 15*a* and 15*c* adjacent thereto in order to eject the ink droplet from the pressure chamber 15*b*. An interval indicated by time Tt is time required to eject the ink droplet, and the time Tt is divided into preparation time T1 (time of preparation interval), ejection time T2 (time of ejection interval) and post processing time T3 (time of post processing interval). Further, the preparation time T1 is subdivided into steady time Ta (time of steady interval) and expansion time (T1−Ta) (time of expansion interval of time); and the ejection time T2 is subdivided into maintenance time Tb (time of maintenance interval) and recovery time (T2−Tb) (time of recovery interval of time). In general, the preparation time T1 composed of the steady time Ta and the expansion time (T1−Ta), the ejection time T2 composed of the maintenance time Tb and the recovery time (T2−Tb) and the post processing time T3 are set to appropriate values depending on the conditions such as used ink, temperature and the like.

As shown in FIG. 5, the head 100 first applies a voltage of 0 volt to the electrode 4 corresponding to the pressure chamber 15*b* at time point t0. At this time, the head 100 also applies the voltage of 0 volt to the electrodes 4 respectively corresponding to the pressure chambers 15*a* and 15*c*. The head 100 stands by after the steady time Ta elapses. Meanwhile, the pressure chambers 15*a*, 15*b* and 15*c* maintain the states shown in FIG. 4(*a*).

At time point t1 after the steady time Ta elapses, the head 100 applies a voltage (−Vs) having the negative polarity to the electrode 4 corresponding to the pressure chamber 15*b*. At this time, the head 100 applies a voltage (+Vs) having the positive polarity to the electrodes 4 respectively corresponding to the pressure chambers 15*a* and 15*c*. The head 100 stands by after the expansion time (T1−Ta) elapses.

If the voltage (−Vs) having the negative polarity is applied to the electrode 4 corresponding to the pressure chamber 15*b*, and the voltage (+Vs) having the positive polarity is applied to the electrodes 4 respectively corresponding to the pressure chambers 15*a* and 15*c*, the partition walls 16*a* and 16*b* at two sides of the pressure chamber 15*b* deform outward so that the volume of the pressure chamber 15*b* is expanded to be a state in FIG. 4(*b*). Through the deformation, the pressure in the pressure chamber 15*b* decreases. Thus, the ink flows from the common ink chamber 5 into the pressure chamber 15*b*.

At time point t2 after the expansion time (T1−Ta) elapses, the head 100 further continues to apply the voltage (−Vs) having the negative polarity to the electrode 4 corresponding to the pressure chamber 15*b*. The head 100 continues to apply the voltage (+Vs) having the positive polarity to the electrodes 4 respectively corresponding to the pressure chambers 15*a* and 15*c*. Meanwhile, the pressure chambers 15*a*, 15*b* and 15*c* maintain the states shown in FIG. 4(*b*).

At time point t3 after the maintenance time Tb elapses, the voltage applied to the electrode 4 corresponding to the pressure chamber 15*b* by the head 100 returns to 0 volt. At this time, the voltage applied to the electrodes 4 respectively corresponding to the pressure chambers 15*a* and 15*c* by the head 100 returns to 0 volt. The head 100 stands by until the recovery time (T2−Tb) elapses.

If the voltage applied to the electrodes 4 respectively corresponding to the pressure chambers 15*a*, 15*b* and 15*c* becomes 0 volt, the partition walls 16*a* and 16*b* at two sides of the pressure chamber 15*b* recover to steady states, and return to the states in FIG. 4(*a*). Through the recovery, the pressure in the pressure chamber 15*b* increases, and the ink droplet is ejected from the nozzle 8 corresponding to the pressure chamber 15*b*.

At time point t4 after the recovery time (T2−Tb) elapses, the head 100 applies the voltage (+Vs) having the positive polarity to the electrode 4 corresponding to the pressure chamber 15*b*. At this time, the head 100 applies the voltage (−Vs) having the negative polarity to the electrodes 4 respectively corresponding to the pressure chambers 15*a* and 15*c*. The head 100 stands by after the post processing time T3 elapses.

If the voltage (+Vs) having the positive polarity is applied to the electrode 4 corresponding to the pressure chamber 15*b*, and the voltage (−Vs) having the negative polarity is applied to the electrodes 4 respectively corresponding to the pressure chambers 15*a* and 15*c*, the partition walls 16*a* and 16*b* at two sides of the pressure chamber 15*b* deform inward so as to reduce the volume of the pressure chamber 15*b*, and return to the states in the FIG. 4(*c*). Through the deformation, the pressure in the pressure chamber 15*b* is further increased. For this reason, pressure drop occurring in the pressure chamber 15*b* after the ejection of the ink droplet is relaxed.

At time point t5 after the post processing time T3 elapses, the voltage applied to the electrode 4 corresponding to the pressure chamber 15*b* by the head 100 returns to 0 volt. At this time, the voltage applied to the electrodes 4 respectively corresponding to the pressure chambers 15*a* and 15*c* by the head 100 also returns to 0 volt. If the voltage applied to the electrodes 4 corresponding to the pressure chambers 15*a*, 15*b* and 15*c* becomes 0 volt, the partition walls 16*a* and 16*b* at two sides of the pressure chamber 15*b* recover to the steady states and return to the states in FIG. 4(*a*). At this time, pressure vibration left in the pressure chamber 15*b* is canceled.

The head 100 supplies drive pulse signals with such reference pulse waveforms to the electrodes 4 of the pressure chamber 15*b* which ejects the ink and the pressure chambers 15*a* and 15*c* adjacent thereto. Then, the partition walls 16*a* and 16*b* each which consists of the piezoelectric members 1 and 2 are driven in such a manner that the volume of the pressure chamber 15*b* is expanded or contracted, and the ink droplet is ejected from the nozzle 8 which corresponds to the pressure chamber 15*b*. Herein, the partition walls 16*a* and 16*b* each which consists of the piezoelectric members 1 and 2 and the electrodes 4 arranged on the partition walls 16*a* and 16*b* constitute an actuator which is driven to eject the ink droplet from the nozzle 8 communicating with the pressure chamber 15*b* partitioned by the partition walls 16*a* and 16*b*.

Next, a case in which the head 100 carries out gradation print with a multidrop method is described. The multidrop method changes the number of the ink droplets thrown to one dot without changing the size of the ink droplet to change density of one dot to realize gradation. Such a print method is realized as long as a drive pulse voltage is repeatedly and continuously applied to the actuator corresponding to the nozzle 8 which ejects the ink for plural times. For example, through applying the drive pulse voltage to the actuator continuously twice, two ink droplets are ejected from the nozzle 8 corresponding to the actuator. Similarly, through applying the drive pulse voltage to the actuator continuously seven times, seven ink droplets are ejected from the nozzle 8 corresponding to the actuator. Thus, the head 100 carries out the gradation print with the multidrop method.

Figure 6:
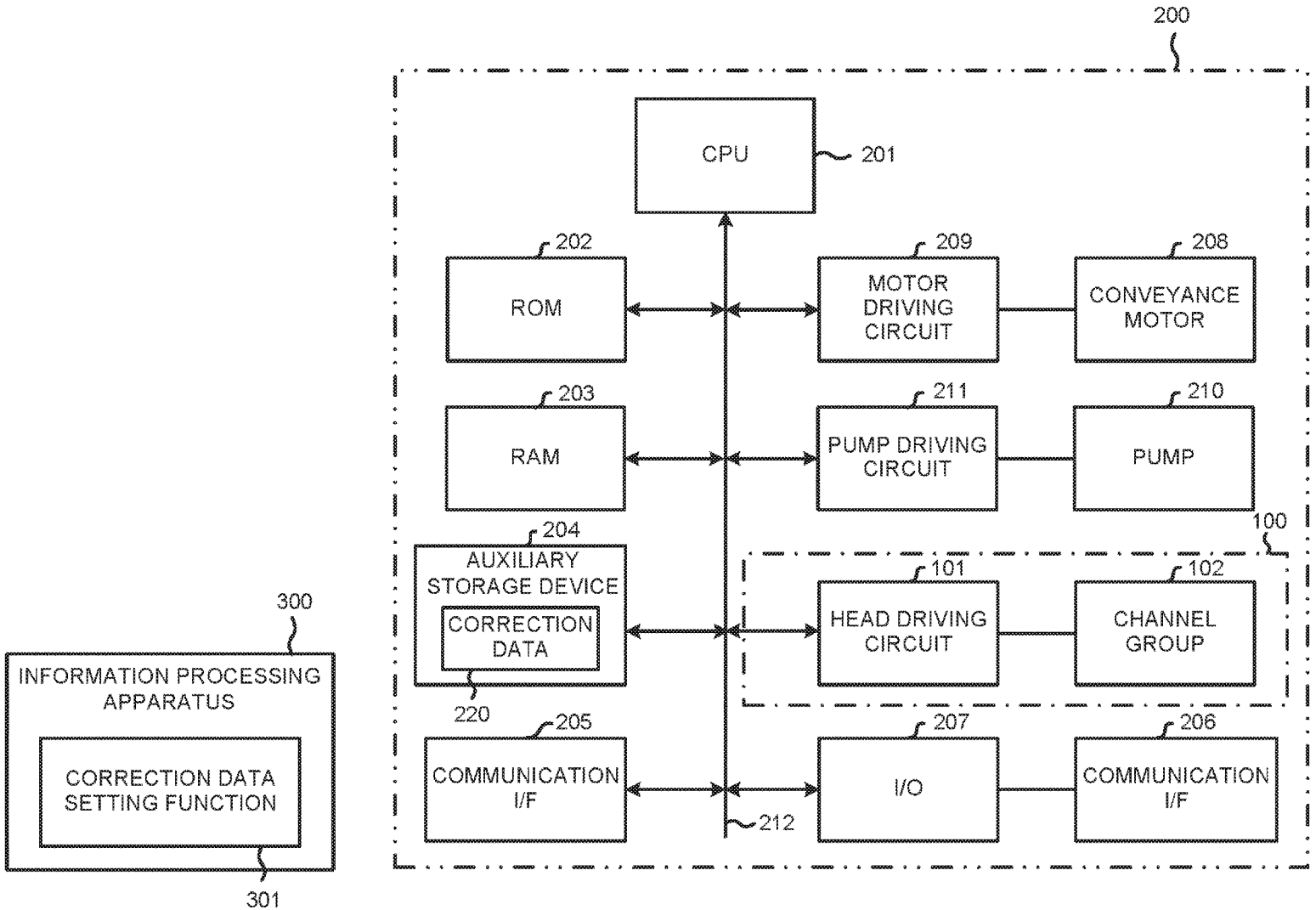
FIG. 6 is a block diagram illustrating the hardware configuration of an inkjet printer according to the embodiment.

Next, an inkjet printer 200 (hereinafter, referred to as a printer 200 for short) which loads such a head 100 is described. FIG. 6 is a block diagram illustrating the hardware configuration of the printer 200. The printer 200 is, for example, a printer for office, a barcode printer, a printer for POS, a printer for industry and the like.

The printer 200 comprises a CPU (Central Processing Unit) 201, a ROM (Read Only Memory) 202, a RAM (Random Access Memory) 203, an auxiliary storage device 204, a communication interface 205, an operation panel 206, an I/O port 207, a conveyance motor 208, a motor drive circuit 209, a pump 210, a pump drive circuit 211 and the head 100. The printer 200 includes a bus line 212 such as an address bus, a data bus and the like. The printer 200 connects the bus line 212 with the CPU 201, the ROM 202, the RAM 203, the auxiliary storage device 204, the communication interface 205, the I/O port 207, the motor drive circuit 209, the pump drive circuit 211 and the drive circuit 101 of the head 100 directly or via an input/output circuit respectively.

The CPU 201 acting as the main unit of the computer controls each section of the printer 200 for realizing various functions of the printer 200 based on an operating system, and an application program.

The ROM 202 acting as a main memory unit of the computer stores the operating system and the application program. The ROM 202 also stores data required to execute a processing for controlling each section by the CPU 201 in some cases.

The RAM 203 acting as the main memory unit of the computer also stores data required to execute a processing by the CPU 201. Further, the RAM 203 is also used as a so-called working area in which information is properly rewritable by the CPU 201. The working area contains an image memory in which print data is copied or decompressed.

The auxiliary memory unit 204 acts as the auxiliary memory unit of the computer. The auxiliary memory unit 204 may be, for example, an HDD, an SSD or an EEPROM. The auxiliary memory unit 204 stores data used by the CPU 201 for executing various processing or data generated through the processing carried out by the CPU 201. The auxiliary storage device 204 stores the application program in some cases. The auxiliary storage device 204 stores a correction data memory 220. The correction data memory 220 stores correction data set for each channel (each nozzle) of the head 100.

The communication interface 205 carries out data communication conforming to a preset communication protocol with an information processing apparatus 300 connected via a communication line 400 such as a LAN (Local Area Network). The information processing apparatus 300 may be a computer device such as a general-purpose personal computer, a tablet terminal and the like. The information processing apparatus 300 has a setting function 301 of the correction data described above. The correction data setting function 301 is realized through hardware such as a processor, a memory and the like provided in the information processing apparatus 300 and a dedicated application program installed in the information processing apparatus 300. The correction data setting function 301 is described in detail later.

The operation panel 206 is equipped with an operation section and a display section. The operation section is equipped with function keys such as a power key, a paper feed key and an error release key. The display section is capable of displaying various states of the printer 200. The operation panel 206 is connected to the bus line 212 via the I/O port 207. The I/O port 207 inputs a signal generated through an operation of the operation section from the operation panel 206. The I/O port 207 outputs display data to the display section to the operation panel 206.

The motor drive circuit 209 controls the drive of the conveyance motor 208. The conveyance motor 208 functions as a driving source of a conveyance mechanism for conveying an image receiving medium such as a print paper. If the conveyance motor 208 is driven, the conveyance mechanism starts to convey the image receiving medium. The conveyance mechanism conveys the image receiving medium to a print position by the head 100. The conveyance mechanism discharges the image receiving medium of which the printing is ended from a discharge port (not shown) to the outside of the printer 200.

The pump drive circuit 211 controls the drive of the pump 210. If the pump 210 is driven, the ink in an ink tank (not shown) is supplied to the head 100.

Figure 7:
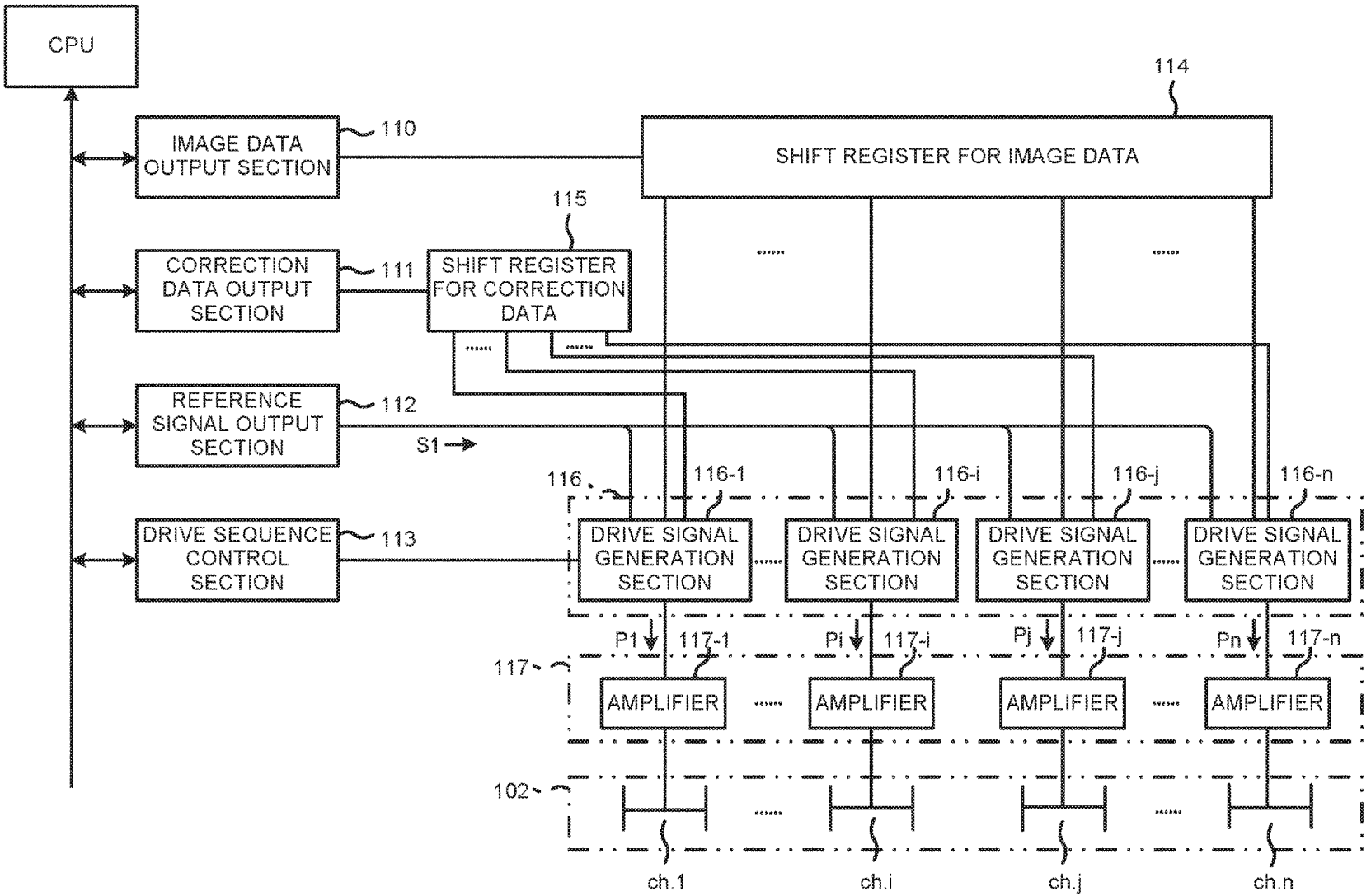
FIG. 7 is a block diagram illustrating the configuration of a head drive circuit of an inkjet head loaded in the inkjet printer.

The head drive circuit 101 drives a channel group 102 of the head 100 based on the print data. As shown in FIG. 7, the channel group 102 includes n channels ch.1, . . . , ch.i, ch.j, . . . , ch.n (1< . . . <i<j . . . <n: ch.1~ch.n) from channel number 1 to channel number n.

FIG. 7 is a block diagram illustrating the configuration of main portions of the head drive circuit 101. The head drive circuit 101 includes an image data output section 110, a correction data output section 111, a reference signal output section 112, a drive sequence control section 113, a shift register for image data 114, a shift register for correction data 115, a plurality of drive signal generation sections 116 (116-1, . . . , **116-*i*, 116-*j*, . . . , 116-*n*), and a plurality of amplifiers 117 (117-1, . . . , 117-*i*, 117-*j*, . . . , 117-*n*). The drive signal generation section 116 and the amplifier 117 are arranged corresponding to each of the channels ch.1~ch.n of the inkjet head 100**.

The image data output section 110 reads out image data line by line from an image memory in the RAM 203 and outputs the image data to the shift register for image data 114. The shift register for image data 114 has a register length corresponding to each of channels ch.1~ch.n of the inkjet head 100 one for one, shifts the image data in one line by a pixel unit in order and stores the image data.

The correction data output section 111 reads out the correction data of each of channels ch.1~ch.n stored in the correction data memory 220 line by line and outputs the correction data to the shift register for correction data 115. The shift register for correction data 115 has a register length corresponding to each of channels ch.1~ch.n of the inkjet head 100 one for one, shifts the correction data in one line in order and stores the correction data.

The reference signal output section 112 outputs a reference signal S1 having a waveform serving as reference of the drive pulse signal for driving drive elements of the inkjet head 100. The drive sequence control section 113 controls output timing of drive pulse signals P1, . . . Pi, Pj, . . . , Pn (P1~Pn) generated for channels ch.1~ch.n by the drive signal generation sections 116 in such a manner that the ink is ejected in order from the nozzles 8 of the adjacent pressure chambers 15 sharing the partition wall.

Each drive signal generation section 116 includes a reference signal input section for inputting the reference signal S1, an image data input section for inputting the image data, a correction data input section for inputting the correction data, and an output section for outputting the drive pulse signal. The drive signal generation sections 116 generate the drive pulse signals P1~Pn which are applied to the electrodes 4 of channels ch.1~ch.n correspondingly according to the reference signal S1 and the image data stored in the shift register for image data 114. At this time, the drive signal generation sections 116 correct the drive pulse signals P1~Pn for the channels ch.1~ch.n through the correction data stored in the shift register for correction data 115. The drive pulse signals P1~Pn corrected with the correction data are applied to the electrodes 4 of the channels ch.1~ch.n correspondingly after amplified by the amplifiers 117.

Figure 8:
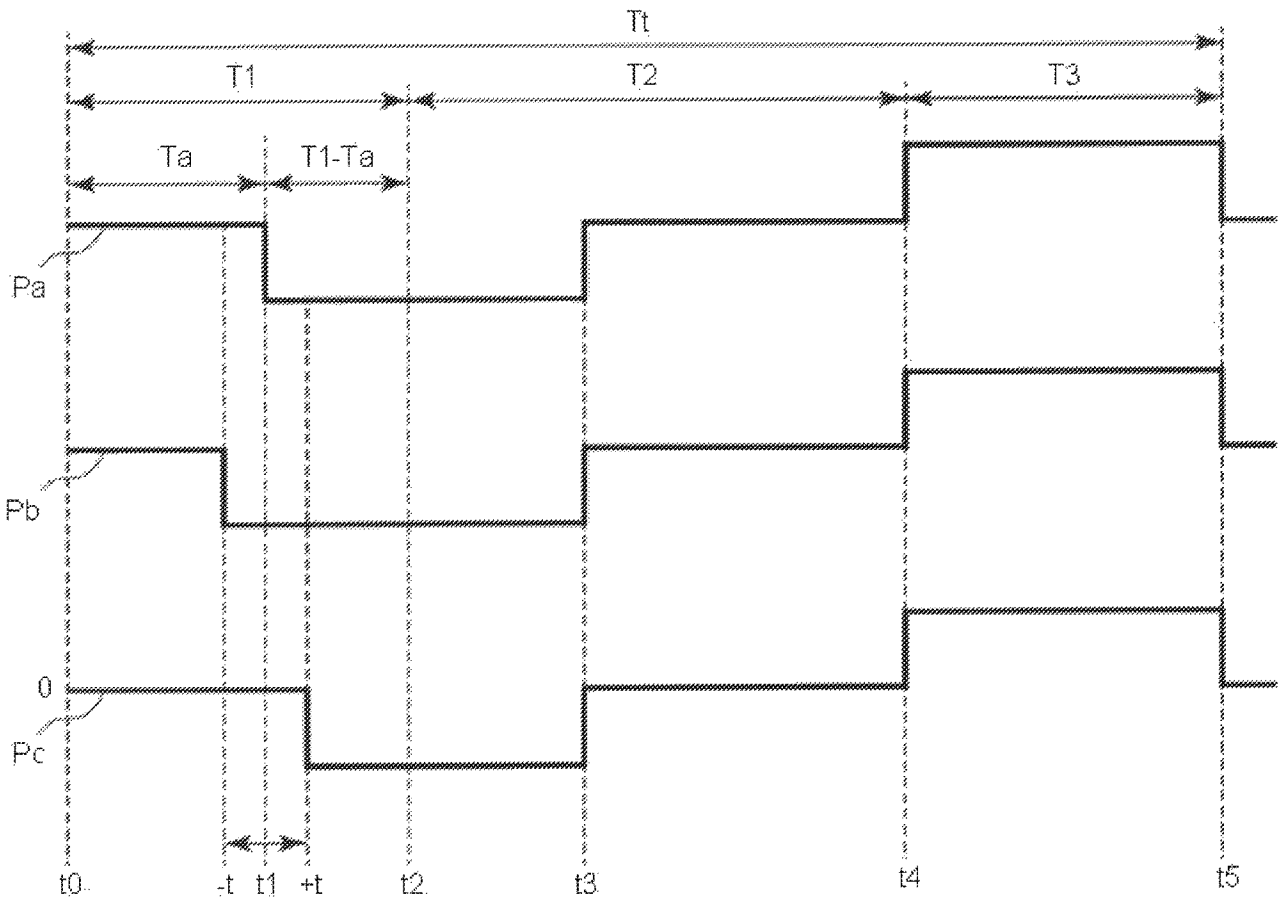
FIG. 8 is a waveform diagram illustrating a correction method of a drive pulse signal.

Herein, a correction method of the drive pulse signals P1~Pn is described with reference to FIG. 8. In FIG. 8, each of pulse waveforms Pa, Pb and Pc is a waveform of the drive pulse signal applied to the electrode 4 corresponding to the pressure chamber **15*b* which ejects the ink. The pulse waveform Pa is a waveform before the correction, and the pulse waveform Pb and the pulse waveform Pc are waveforms after the correction. The pulse waveform Pa is coincident with the reference pulse waveform shown as the drive pulse signal applied to the pressure chamber 15*b* in FIG. 5**.

As can be known by comparing the pulse waveforms Pa, Pb and Pc, in the present embodiment, the preparation time T1 of the reference pulse waveform necessary to eject one drop of the ink droplet is corrected. In particular, the time point t1 at which the steady time Ta is switched to the expansion time (T1−Ta) in the preparation time T1 is changeable in a range from time "−t" to "+t" depending on the correction data. The ejection time T2 and the post processing time T3 are not corrected.

If the steady time Ta is shortened, in other words, the time point t1 is corrected in a "−t" direction, the expansion time (T1−Ta) is lengthened. As a result, the volume of the ink droplet ejected from the nozzle 8 is increased. If the steady time Ta is lengthened, in other words, the time point t1 is corrected in a "+t" direction, the expansion time (T1−Ta) is shortened. As a result, the volume of the ink droplet ejected from the nozzle 8 is decreased. The correction data sets how much the time point t1 is shifted in the "−t" direction or the "+t" direction.

Figure 9:
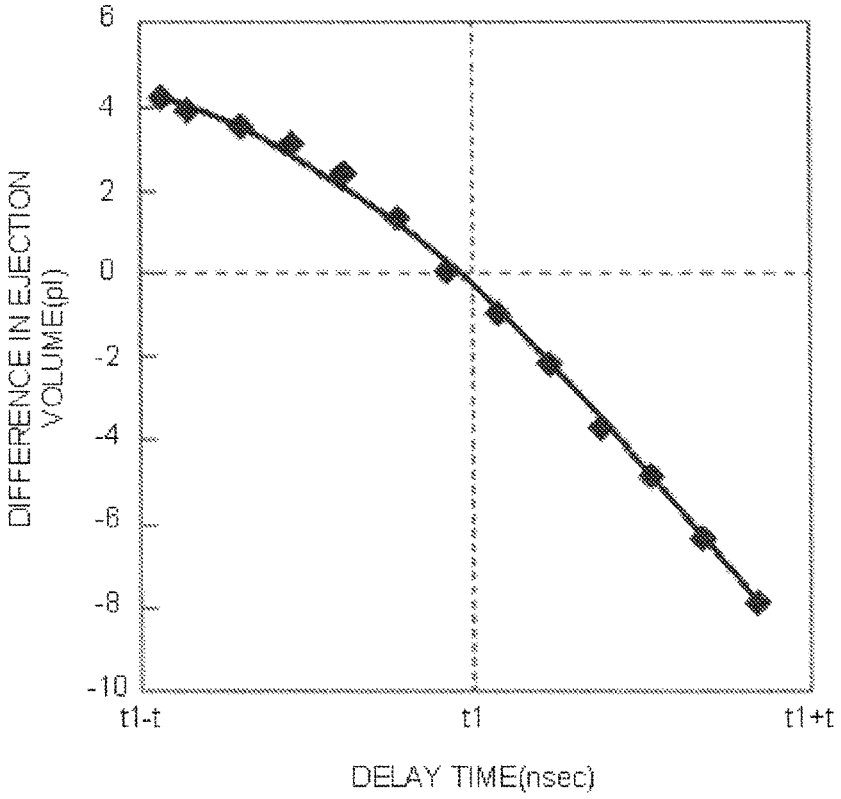
FIG. 9 is a characteristic diagram illustrating correspondence relationship between ejection volume and delay time used to explain the correction method of the drive pulse signal.

FIG. 9 is a graph illustrating a correspondence relationship between ejection volume (vertical axis) and delay time (horizontal axis) in a case in which 7 drops of the ink droplets are ejected from the nozzle 8 at the time when the time point t1 is delayed stepwise within the range from the time "−t" to "+t". The ejection volume (p1) of the vertical axis indicates a difference with respect to the ejection volume when the time point t1 is not corrected. As can be seen from the graph in FIG. 9, the relationship between the ejection volume (p1) and the delay time (nsec) has a function characteristic, that is, the greater the delay time (nsec) becomes, the smaller ejection volume (p1) is.

In this way, through correcting the time point t1 of the drive pulse signals P1~Pn for channels ch.1~ch.n in a delay direction (+ direction) or an acceleration direction (− direction), the ejection amount of the ink droplet respectively ejected from the channels ch.1~ch.n can be adjusted. In other words, by setting positive or negative correction time t (nsec) for the time point t1 for channels ch.1~ch.n as the correction data, the ejection amount of the ink droplet ejected from each nozzle 8 can be uniform. If the ejection amount is uniform, the density unevenness is eliminated. The level difference of the density at the boundary of the first head and the second head arranged in the arrangement direction of the nozzle 8 does not occur.

The correction data (correction time t (nsec)) of each of the channels ch.1~ch.n is set in the correction data memory 220 by the correction data setting function 301 provided in the information processing apparatus 300.

Then, the correction data setting function 301 is described. For the convenience of the description, the number of the nozzles 8 in the head 100 is set to "320". In other words, the head 100 has channels ch.1~ch.320 with the channel numbers "1"~"320". A nozzle number n which is an identification number for identifying the nozzle 8 of the channel number "i" is defined as "i−1". For example, the nozzle 8 with the nozzle number "0" is equal to the nozzle 8 of the channel ch.1 with the channel number "1". The nozzle 8 with the nozzle number "319" is equal to the nozzle 8 of the channel ch.320 with the channel number "320".

The head 100 processes 320 nozzles 8 with a dedicated processing machine. At that time, the processing machine processes the nozzles 8 separately 20 times by taking 16 nozzles 8 as one unit from one end to the other end of the head 100 along the arrangement direction of the nozzles 8. Thus, the density unevenness caused by the dispersion in each processing point of the processing machine may occur in 16 nozzles 8 which are collectively processed in some cases. In that case, as a batch processing of 16 nozzles 8 is repeated 20 times, the density unevenness taking 16 nozzles 8 as a cycle occurs 20 times in the spatial direction in which the nozzles 8 are arranged. Such density unevenness is numerically slight, but is conspicuous as there is a periodicity.

There is a possibility that the density unevenness occurs due to other main reasons in individual processing cycle of 20 times. For example, the temperature of the processing machine rises along with the increase in the processing times, and the dispersion occurs in the degree of the processing due to the temperature rise. The density unevenness taking 16 nozzles 8 as a cycle becomes large or small.

Hereinafter, the correction data setting function 301 for effectively correcting the cyclic density unevenness due to the processing of such a head 100 is described in detail.

Figure 10:
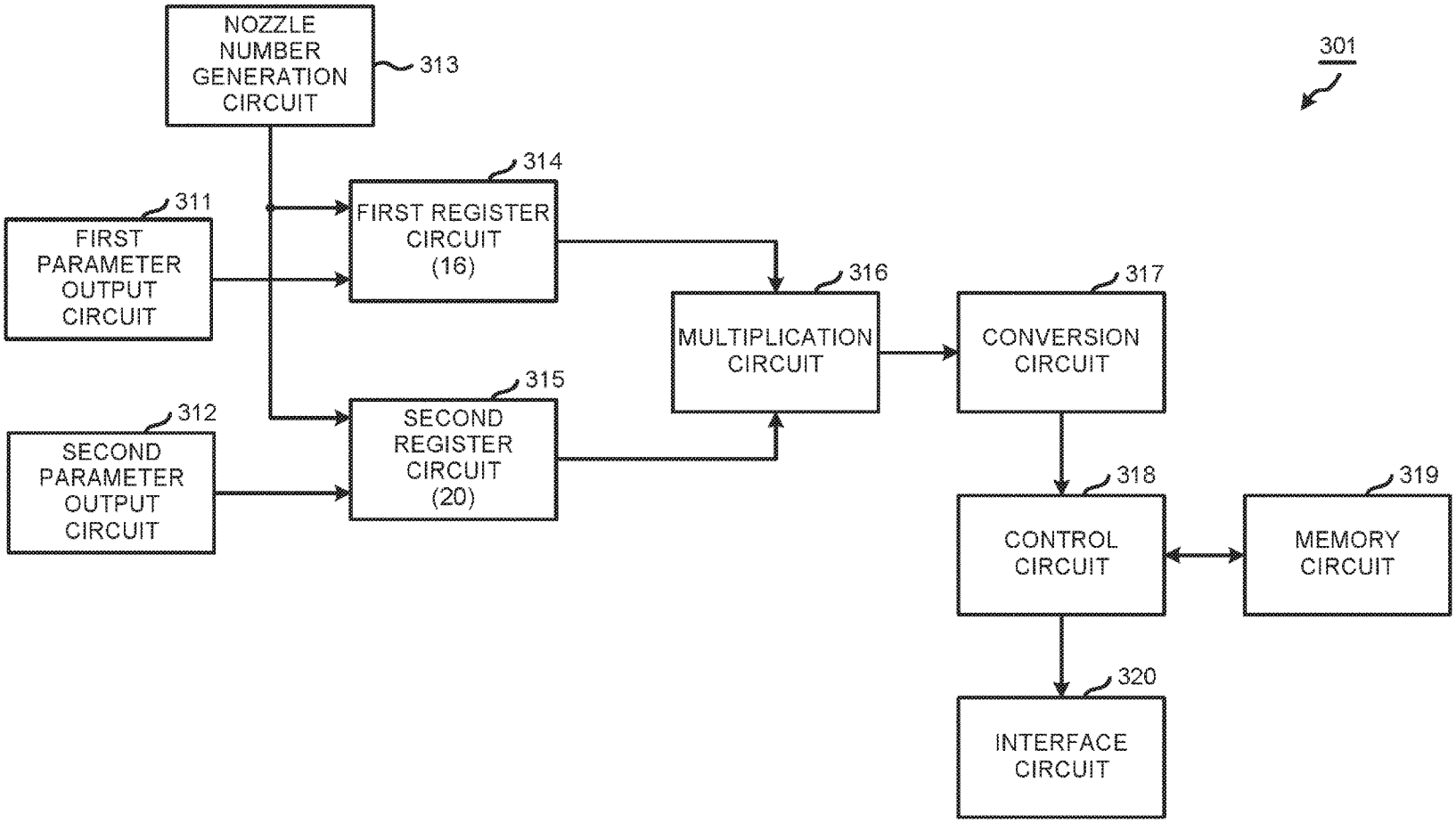
FIG. 10 is a block diagram illustrating the circuit configuration necessary to realize a correction data setting function.

FIG. 10 is a block diagram illustrating the circuit configuration necessary to realize the correction data setting function 301. The correction data setting function 301 necessarily includes a first parameter output circuit 311, a second parameter output circuit 312, a nozzle number generation circuit 313, a first register circuit 314, a second register circuit 315, a multiplication circuit 316, a conversion circuit 317, a control circuit 318, a memory circuit 319 and an interface circuit 320. The first parameter output circuit 311 and the second parameter output circuit 312 are mainly composed of an input device (a keyboard, a touch panel, etc.) provided in the information processing apparatus 300. The interface circuit 320 is mainly composed of a communication interface (a LAN controller, a USB interface, etc.) provided in the information processing apparatus 300. The nozzle number generation circuit 313, the first register circuit 314, the second register circuit 315 and the memory circuit 319 are mainly realized by a volatile memory (a RAM, an auxiliary storage device, etc.) provided in the information processing apparatus 300. The multiplication circuit 316, the conversion circuit 317 and the control circuit 318 are mainly realized by a processor (a CPU, a MPU, etc.) and a program memory (a ROM, an auxiliary storage device, etc.) provided in the information processing apparatus 300.

The first parameter output circuit 311 outputs 16 correction parameters A1~A16 (hereinafter, referred to as first correction parameters A1~A16) calculated for each nozzle 8 to the first register circuit 314 so that the density unevenness of the ink ejected from 16 nozzles 8 which are collectively processed by the processing machine is corrected.

The second parameter output circuit 312 outputs 20 correction parameters B1~B20 (hereinafter, referred to as second correction parameters B1~B20) calculated for each processing times to the second register circuit 315 so that change rate of the density unevenness occurring each time the batch processing of the nozzle 8 is repeated is corrected.

The nozzle number generation circuit 313 generates the nozzle number n from "0" to "319" in ascending order from "0" to "319". Alternatively, the nozzle number generation circuit 313 generates the nozzle number n in descending order from "319" to "0". The nozzle number generation circuit 313 may randomly generate the nozzle number n of "0" to "319".

The minimum value of the nozzle number n is "0", and the maximum value thereof is "319". Thus, the nozzle number n is composed of 9-bit data. Incidentally, if the maximum value of the nozzle number n is greater than "512", the nozzle number n is composed of data of 10 or more bits.

Among 9-bit data generated from the nozzle number generation circuit 313, low-order four-bit data is output to the first register circuit 314, high-order five-bit data is output to the second register circuit 315.

The low-order four-bit data of the nozzle number n is repeated by taking 16 nozzle numbers as one group, for example, the nozzle numbers "0"~"15", the nozzle numbers "16"~"31", the nozzle numbers "32"~"47", . . . . In the present embodiment, the number of the nozzles 8 collectively processed by the processing machine is 16. The first correction parameters A1~A16 for correcting the density unevenness occurring in 16 nozzles 8 are output from the first parameter output circuit 311 to the first register circuit 314. Thus, the low-order four-bit data is output to the first register circuit 314.

The high-order five-bit data of the nozzle number n indicates a value counted up one by one from an initial value "0" by taking 16 nozzle numbers as one group, for example, the nozzle numbers "0"~"15" are "0", the nozzle numbers "16"~"31" are "1", the nozzle numbers "32"~"47" are "2", . . . . At the maximum value "319" of the nozzle number n, the high-order five-bit data indicates "20". In the embodiment, the batch processing of the nozzles 8 is repeated 20 times to manufacture the head 100. The second correction parameters B1~B20 for correcting the change rate of the density unevenness occurring each time the batch processing of the nozzles 8 is repeated are output from the second parameter output circuit 312 to the second register circuit 315. Thus, the high-order five-bit data is output to the second register circuit 315.

Figure 11:
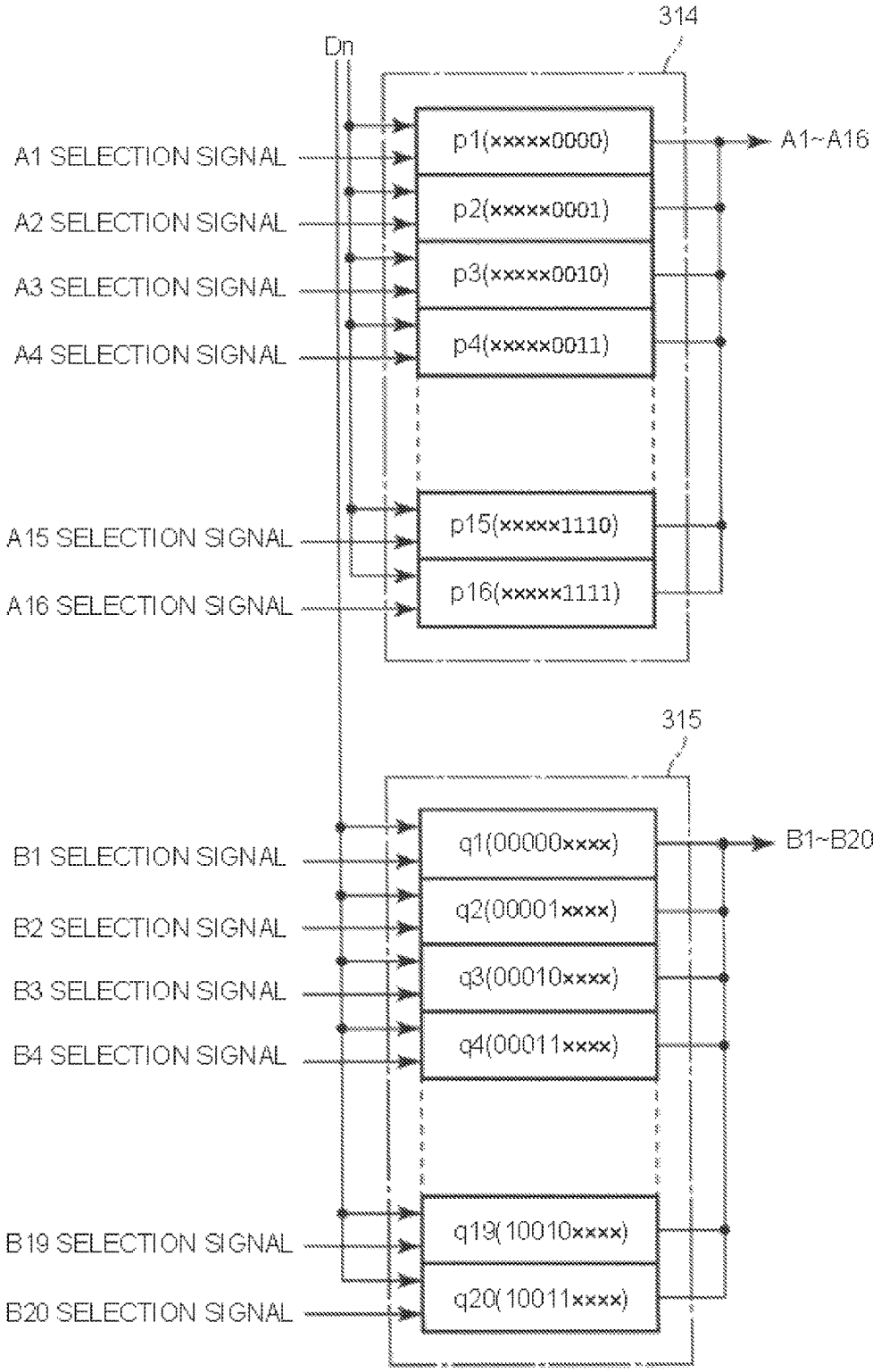
FIG. 11 is a schematic diagram illustrating a first register circuit and a second register circuit shown in FIG. 10.

The first register circuit 314 and the second register circuit 315 are described in detail with reference to FIG. 11. As shown in FIG. 11, the first register circuit 314 contains 16 registers in total from a first register p1 to a sixteenth register p16. The first correction parameters A1~A16 are set in order respectively in each of the registers p1~p16. The second register circuit 315 contains 20 registers in total from a first register q1 to a twentieth register q20. The second correction parameters B1~B20 are set in order respectively in each of the registers q1~q20.

In data Dn representing the 9-bit nozzle number n generated from the nozzle number generation circuit 313, the low-order four bits are decoded and input to each of the registers p1~p16 of the first register circuit 314 as a selection signal, and the high-order five bits are decoded and input to each of the registers q1~q20 of the second register circuit 315 as a selection signal.

In the first register circuit 314, the first register p1 outputs the first correction parameter A1 when the low-order four bits are "0000". The second register p2 outputs the first correction parameter A2 when the low-order four bits are "0001". The third register p3 outputs the first correction parameter A3 when the low-order four bits are "0010". The operations for the fourth~the sixteenth registers p4~p16 are the same. In other words, the sixteenth register p16 outputs the first correction parameter A16 when the low-order four bits are "1111".

In the second register circuit 315, the first register q1 outputs the second correction parameter B1 when the high-order five bits are "00000". The second register q2 outputs the second correction parameter B2 when the high-order five bits are "00001". The third register q3 outputs the second correction parameter B3 when the high-order five bits are "00010". The operations for the fourth~the twentieth registers q4~q20 are the same. In other words, the twentieth register q20 outputs the second correction parameter B20 when the high-order five bits are "10011".

According to the nozzle number n generated from the nozzle number generation circuit 313, both the first correction parameters A1~A16 output from the first register circuit 314 and the second correction parameters B1~B20 output from the second register circuit 315 are output to the multiplication circuit 316.

Figure 16:
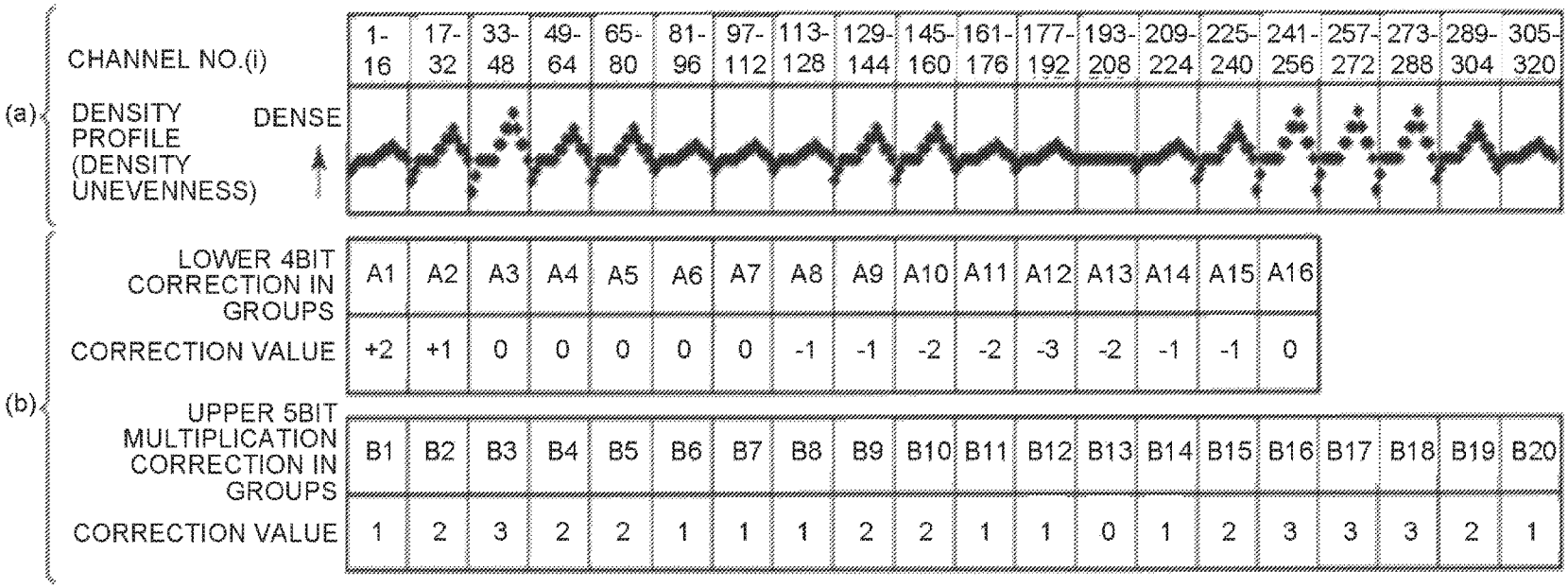
FIG. 16 is a diagram exemplifying a density profile that is correctable with multiplication correction.

The multiplication circuit 316 multiplies the first correction parameters A1~A16 output from the first register circuit 314 by the second correction parameters B1~B20 output from the second register circuit 315. The first correction parameters A1~A16 are used to correct the density unevenness occurring in 16 nozzles 8 which are collectively processed by the processing machine. The second correction parameters B1~B20 are used to correct the change rate of the density unevenness occurring each time the batch processing of the nozzles 8 is repeated. Thus, by multiplying the first correction parameters A1~A16 by the second correction parameters B1~B20 by the multiplication circuit 316, the products [B1(A1~A16), B2(A1~A16), . . . , B20(A1~A16)] become the density correction amount X for the nozzle 8 identified by the nozzle number n generated from the nozzle number generation circuit 313. In other words, the density correction amount X for correcting the density unevenness occurring at the time of processing the nozzle 8 of the channel ch.(n+1) with the channel number (n+1) is calculated by the multiplication circuit 316. The density correction amount X is output to the conversion circuit 317. For example, in a case in which the head has a density profile of each nozzle shown in the graph in FIG. 16(*a*), the first correction parameters A1~A16 and the second correction parameters B1~B20 are set to values shown in corresponding graph in FIG. 16(*b*), and the density correction amount X=A*B is output to the conversion circuit 317.

Figures 12, 13:
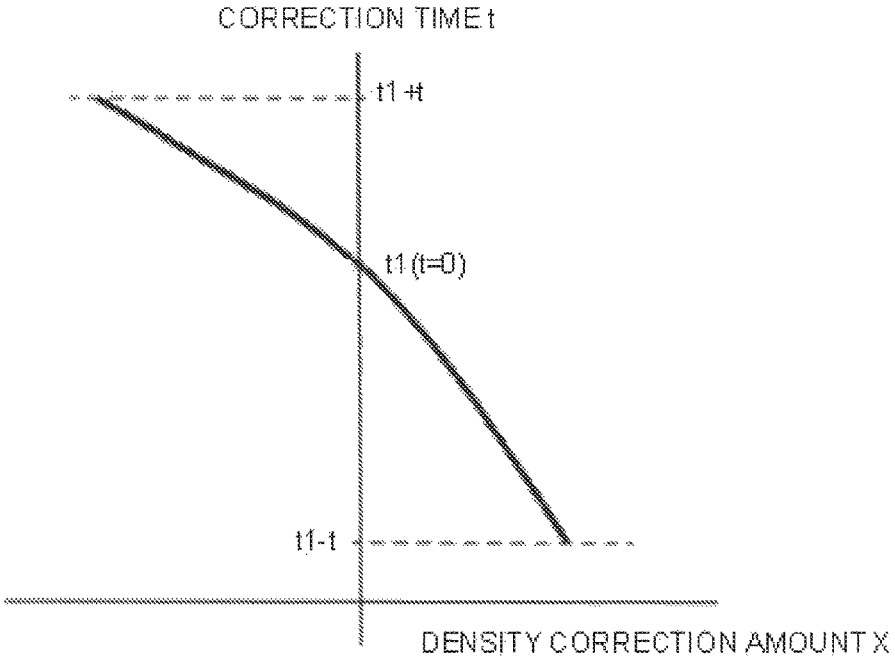
FIG. 12 is a character diagram illustrating a conversion table used in a conversion circuit shown in FIG. 10.
FIG. 13 is a schematic diagram illustrating data structure of a correction data table stored in a memory circuit shown in FIG. 10.

The conversion circuit 317 converts the density correction amount X calculated by the multiplication circuit 316 to the correction time t (nsec). In the conversion, a conversion table having the function characteristic of the graph shown in FIG. 12 is used. The function characteristic of the conversion table is calculated from the function characteristic of the graph shown in FIG. 9. In other words, in FIG. 9, if the horizontal axis (the delay time) is set to x and the vertical axis (difference in ejection volume) is set to y, each point in the graph is represented by coordinates (x, y). On the other hand, as the conversion table is used to convert the density correction amount X to the correction time t (nsec), as shown in FIG. 12, the horizontal axis is set to the density correction amount X, and the vertical axis is set to the correction time t (nsec). Coordinates (x, y) of each point in the graph shown in FIG. 9 is replaced with coordinates (y, x). In other words, the value of y coordinate is set to the density correction amount X of the conversion table, and the value of x coordinate is set to the correction time t (nsec) of the conversion table. Thus, the conversion table shown in FIG. 12 is created from the graph shown in FIG. 9.

The conversion circuit 317 uses the function characteristic of the conversion table to convert the density correction amount X of the nozzle 8 identified by the nozzle number n to the correction time t (nsec). The conversion circuit 317 outputs paired data consisting of the nozzle number n and the correction time t (nsec) to the control circuit 318.

The control circuit 318 converts the nozzle number n to the channel number i (i=n+1) each time the control circuit 318 receives the paired data consisting of the nozzle number n and the correction time t (nsec) from the conversion circuit 317. The control circuit 318 creates the correction data table T with data structure shown in FIG. 13 in the memory circuit 319. The control circuit 318 stores the correction time t (nsec) constituting a pair with the nozzle number n before the conversion of the channel number in ascending order of the channel number i in the correction data table T.

If the creation of the correction data table T from the channel number i=1 to the channel number i=320 is ended, the control circuit 318 notifies the interface circuit 320 to output data of the correction data table T to the printer 200. The interface circuit 320 generates a setting command containing the data of the correction data table T stored in the memory circuit 319 and transmits the setting command to the printer 200 via the communication line 400.

The printer 200 receiving a setting command sets the correction data (paired data group consisting of the channel number i and the correction time t (nsec)) of the correction data table T contained in the command in the correction data memory 220. Hereinafter, the printer 200 corrects the time point t1 which switches from the steady time Ta of the reference pulse waveform for each channel to the expansion time (T1−Ta) i with the correction data to carry out the printing.

Herein, the control circuit 318, the memory circuit 319 and the interface circuit 320 function as a setting section which sets the correction data obtained by the conversion circuit 317 in the correction data memory 220.

In this way, through enabling the correction data setting function 301 to operate in the information processing apparatus 300, the correction data for correcting the pulse width of the drive pulse signal applied to each actuator respectively corresponding to each nozzle 8 of the head 100 is set in the correction data memory 220 of the printer 200.

Herein, the parameters necessary to enable the correction data setting function 301 to operate are the first parameter and the second parameter. The first parameter is the correction data calculated for each nozzle 8 for correcting the density unevenness occurring in a plurality of the nozzles 8 which is collectively processed by the processing machine. The second parameter is the correction data calculated for each processing times for correcting the change rate of the density unevenness occurring each time the batch processing of the nozzles 8 is repeated.

In a case of setting the number of the nozzles which are collectively processed to p and setting the times the batch processing is repeated is q, the number of the nozzles of the head 100 is "p*q". On the other hand, the number of the parameters necessary to enable the correction data setting function 301 to operate is "p+q". Thus, as it is possible to significantly reduce the amount of the correction data required to be set, the correction data for correcting the pulse width of the drive pulse signal applied to each actuator respectively corresponding to each nozzle 8 of the head 100 can be easily set in the correction data memory 220.

Second Embodiment

In the first embodiment, the correction data is calculated by considering the density unevenness occurring in a plurality of the nozzles 8 which is collectively processed by the processing machine and the change rate of the density unevenness occurring between groups of the nozzles 8 which are collectively processed through repeating the batch processing of the nozzles 8. The increase or decrease in the ink density occurring between groups of the nozzles 8 which are collectively processed is not considered. Thus, a correction data setting function 302 which also considers the increase or decrease in the ink density occurring between groups of the nozzles 8 which are collectively processed is described with reference to FIG. 14 and FIG. 15.

Figure 14:
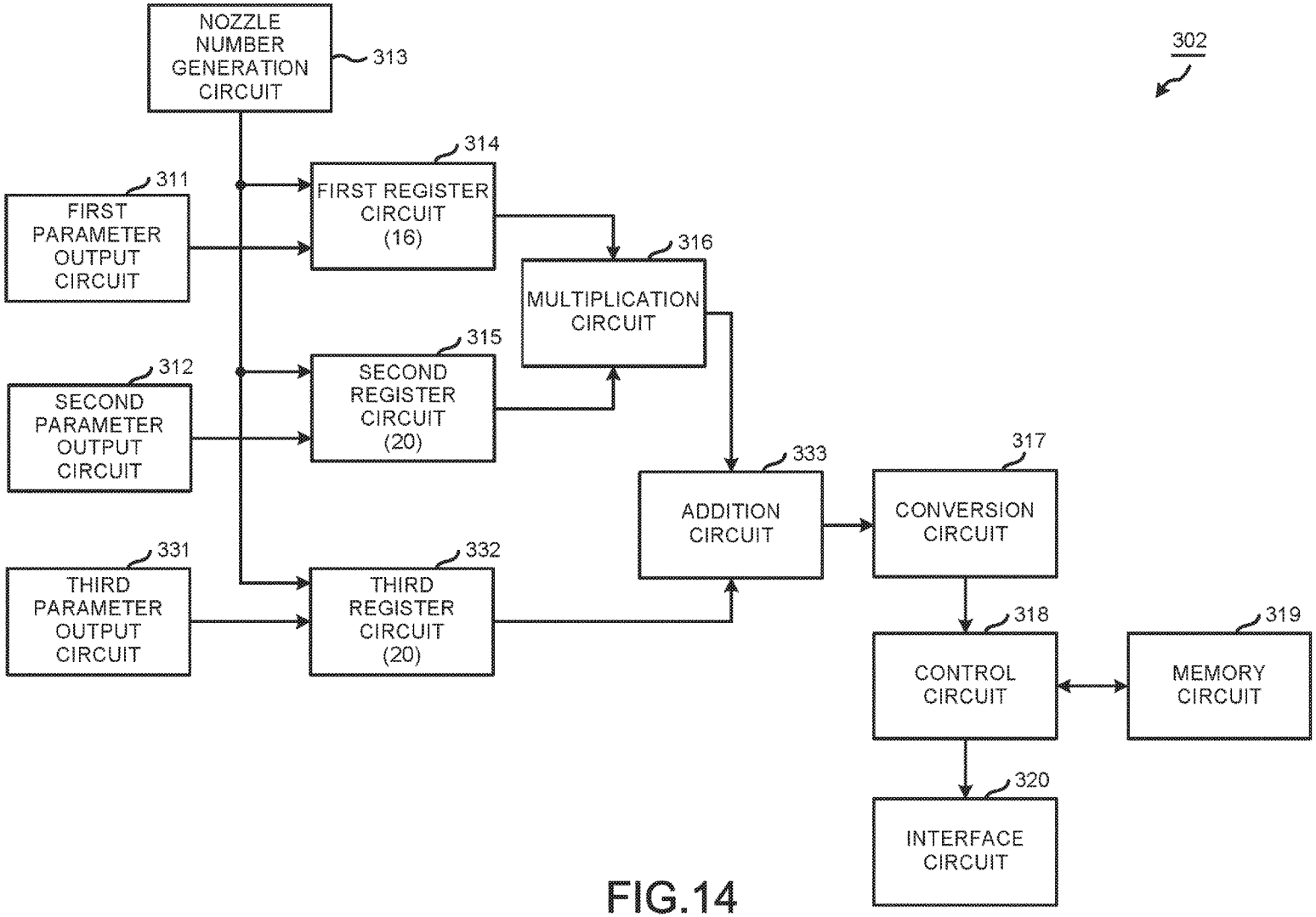
FIG. 14 is a block diagram illustrating the circuit configuration necessary to realize a correction data setting function according to a second embodiment.

FIG. 14 is a block diagram illustrating the circuit configuration necessary to realize the correction data setting function 302. Further, the sections which are common with the correction data setting function 301 shown in FIG. 10 are assigned with the same marks, and the detailed description thereof is omitted.

As shown in FIG. 14, the correction data setting function 302 further includes a third parameter output circuit 331, a third register circuit 332 and an addition circuit 333 in addition to configuration components of the correction data setting function 301.

The third parameter output circuit 331 outputs 20 correction parameters C1~C20 (hereinafter, referred to as third correction parameters C1~C20) calculated for each processing times in order to correct the increase or decrease in the ink density occurring between groups of the nozzles 8 which are collectively processed to the third register circuit 332.

Figure 15:
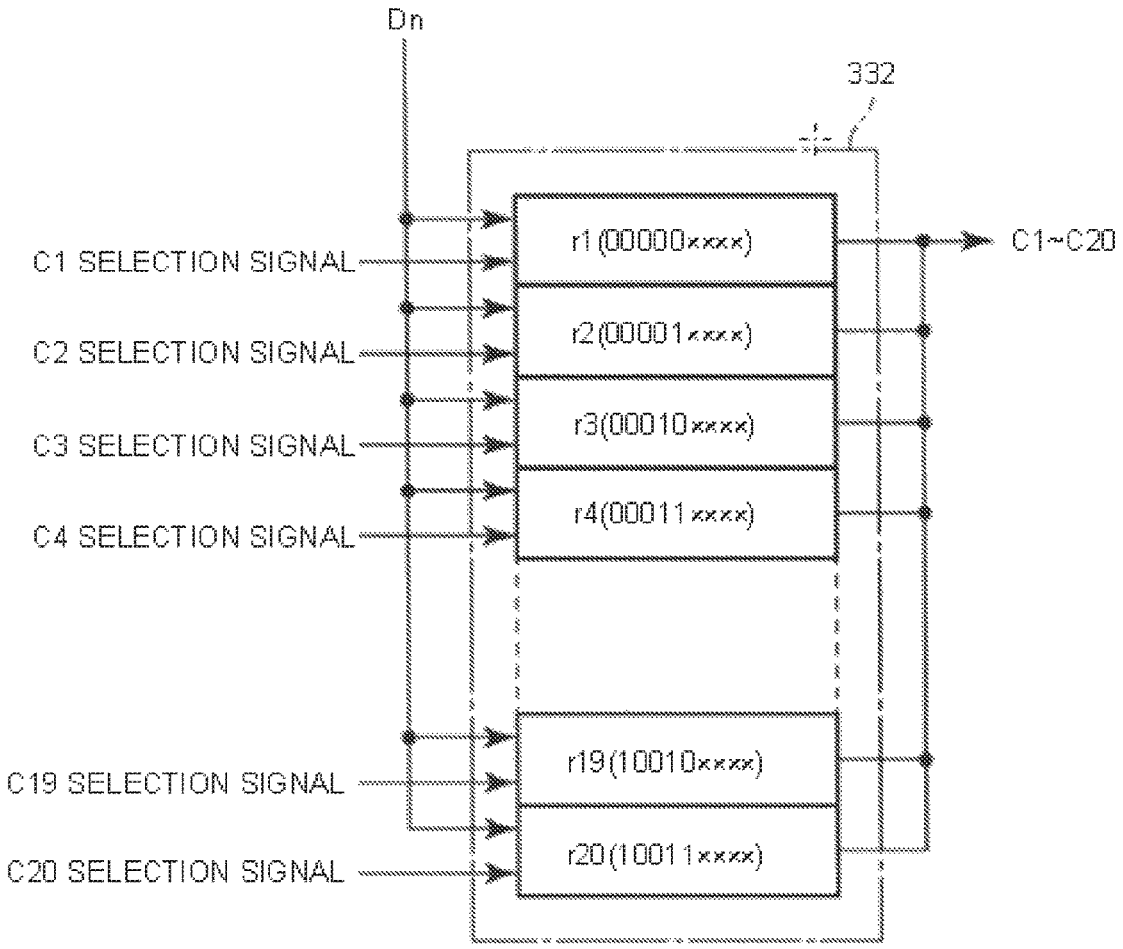
FIG. 15 is a schematic diagram illustrating a third register circuit in FIG. 14.

The third register circuit 332 is described in detail with reference to FIG. 15. As shown in FIG. 15, the third register circuit 332 contains 20 registers in total from a first register r1 to a twentieth register r20. The third correction parameters C1~C20 are respectively set in each of the registers r1~r20.

In data Dn representing the 9-bit nozzle number n generated from the nozzle number generation circuit 313, the low-order four bits are decoded and input to each of registers p1~p16 of the first register circuit 314 as a selection signal, and the high-order five bits are decoded and input to each of the registers q1~q20 of the second register circuit 315 and each of the registers r1~r20 in the third register circuit 332 as a selection signal.

In the third register circuit 332, the first register r1 outputs the third correction parameter C1 when the high-order five bits are "00000". The second register r2 outputs the third correction parameter C2 when the high-order five bits are "00001". The third register r3 outputs the third correction parameter C3 when the high-order five bits are "00010". The operations of the fourth~the twentieth registers r4~r20 are the same. In other words, the twentieth register r20 outputs the third correction parameter C20 when the high-order five bits are "10011".

According to the nozzle number n generated from the nozzle number generation circuit 313, both the first correction parameters A1~A16 output from the first register circuit 314 and the second correction parameters B1~B20 output from the second register circuit 315 are output to the multiplication circuit 316. Thus, the first correction parameters A1~A16 are multiplied by the second correction parameters B1~B20 by the multiplication circuit 316, the products [B1 (A1~A16), B2 (A1~A16), . . . , B20 (A1~A16)] are input to the addition circuit 333.

Figure 17:
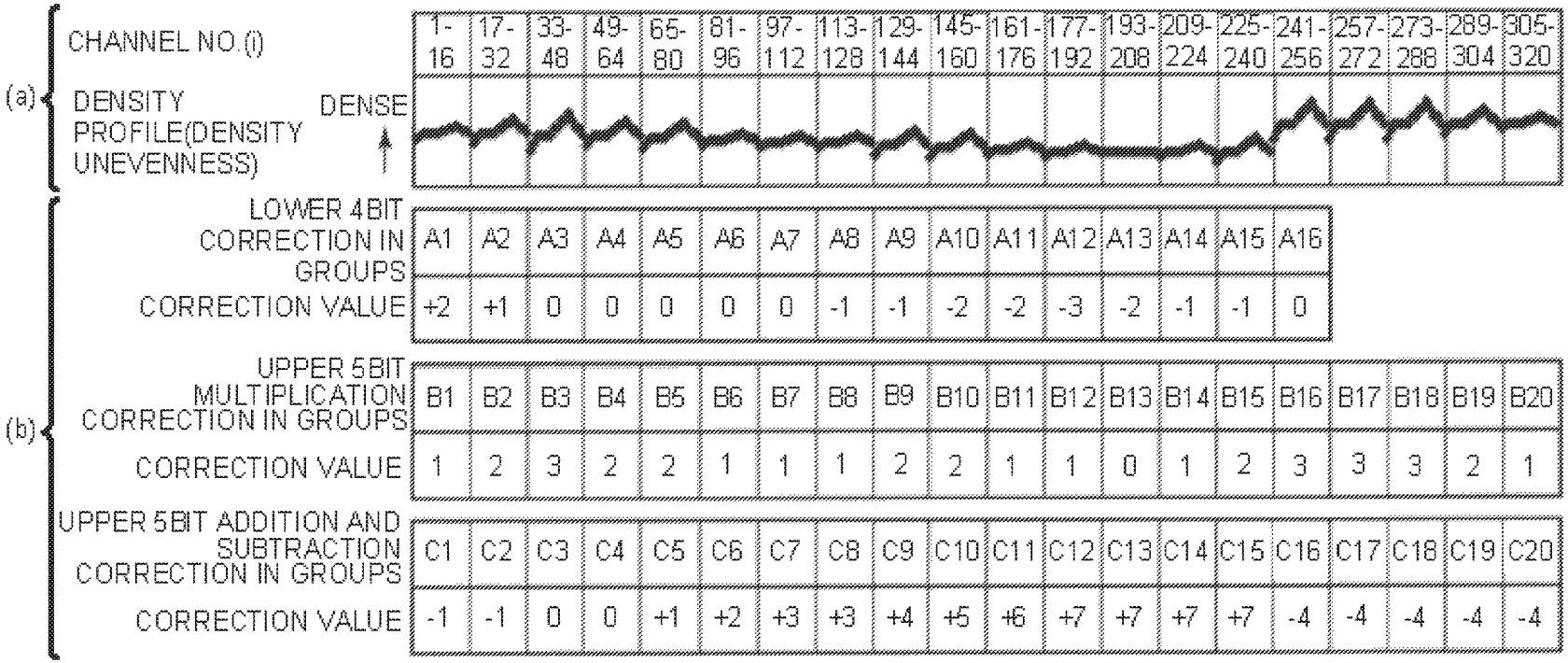
FIG. 17 is a diagram exemplifying a density profile that is correctable by adding addition and subtraction correction to the multiplication correction.

On the other hand, the third correction parameters C1~C20 output from the third register circuit 332 is input to the addition circuit 333. The addition circuit 333 sequentially adds the third correction parameters C1~C20 to the products [B1 (A1~A16), B2 (A1~A16), . . . , B20 (A1~A16)] serving as the output of the multiplication circuit 316. In other words, the sum serving as the output of the addition circuit 333 becomes [{B1 (A1~A16)}+C1, {B2 (A1~A16)}+C2, . . . , {B20 (A1~A16)}+C20]. In this way, by adding the third correction parameters C1~C20 to the output of the multiplication circuit 316, the increase or decrease in the ink density occurring between groups of the nozzles 8 which are collectively processed is also corrected. In other words, the output of the addition circuit 333 becomes the density correction amount X of the nozzle 8 identified by the nozzle number n generated from the nozzle number generation circuit 313. For example, in a case in which the head has a density profile of each nozzle shown in the graph in FIG. 17(*a*), the first correction parameters A1~A16, the second correction parameters B1~B20 and the third correction parameters C1~C20 are set to values shown in corresponding graph in FIG. 17(*b*), and the density correction amount X=A*B+C is output to the conversion circuit 317. The density correction amount X is output to the conversion circuit 317 and is converted to the correction data of each nozzle 8. Herein, the correction data of each nozzle 8 is set in the correction data memory 220 of the printer 20 through the function of the control circuit 318, the memory circuit 319 and the interface circuit 320.

In this way, even in the second embodiment, through enabling the correction data setting function 302 to operate, the correction data for correcting the pulse width of the drive pulse signal applied to each actuator respectively corresponding to each nozzle 8 of the head 100 is set in the correction data memory 220 of the printer 200. Herein, in a case of setting the number of the nozzles which are collectively processed as p, and the times the batch processing is repeated to q, the number of the nozzles of the head 100 is "p*q". On the other hand, the number of parameters necessary to enable the correction data setting function 302 to operate is "p+2q". Thus, similarly to the first embodiment, an effect that the correction data for correcting the pulse width of the drive pulse signal applied to each actuator respectively corresponding to each nozzle 8 of the head 100 can be easily set in the correction data memory 220 can be achieved.

Furthermore, the present invention is not limited to the foregoing embodiments. For example, in the embodiments described above, in the control circuit 318, the nozzle number n is converted to the channel number i (i=n+1) each time the paired data consisting of the nozzle number n and the correction time t (nsec) is received from the conversion circuit 317; however, the conversion of the nozzle number n is not necessarily converted to the channel number i (i=n+1). The channel number in the correction data table T1 is replaced with the nozzle number, and in this way, there is no need to convert the nozzle number n to the channel number i (i=n+1). In this case, the nozzle number in the correction data table T1 may be converted to the channel number at the printer 200 side which receives the correction data table T1.

In the embodiments described above, the nozzles 8 are divided into groups for each predetermined number along the arrangement direction; however, the nozzles 8 may not be necessarily divided along the arrangement direction. For example, the nozzles 8 with the nozzle numbers "0", "10", "20" . . . , that is, every 11th nozzle 8 are set as a first group, the nozzles with the nozzle numbers "1", "11", "21", . . . are set as a second group, and so on, the nozzles 8 at a predetermined interval may be divided into groups for each certain number.

The cutting machine is used when the groove 3 of the head 100 is processed. At that time, for example, first of all, the positions of the piezoelectric members 1 and 2 corresponding to the nozzles with the nozzle numbers "0", "10", "20" . . . , are collectively cut by the cutting machine to form the grooves 3. Subsequently, the relative position of the cutting machine and the piezoelectric members 1 and 2 is shifted slightly in the arrangement direction of the nozzle 8. The positions of the piezoelectric members 1 and 2 corresponding to the nozzles with the nozzle numbers "1", "11", "21" . . . , are collectively cut by the cutting machine to form the grooves 3. In such a case, the nozzles 8 at a predetermined interval may be divided into groups for each certain number.

The correction data setting function 301 or 302 and each component thereof may be realized by hardware such as a processor, a memory and the like and a dedicated application program, or may also be realized by dedicated hardware. Further, one part of the components is realized by hardware, and the other part thereof is realized by a program.

The first parameter output circuit 311 and the second parameter output circuit 312 of the correction data setting function 301 or 302 and the third parameter output circuit 331 of the correction data setting function 302 may be mainly composed of an input device (a keyboard, a touch panel, etc.) provided in the information processing apparatus 300, or may be data stored in a non-volatile memory.

The information processing apparatus 300 may have a function of supplying the correction data to the printer 200 and a function of supplying image data for printing to the printer 200. The information processing apparatus 300 may only have a function of supplying the correction data to the printer 200, and the image data for printing may be provided to the printer 200 by another means.

The correction data setting function 301 or 302 may be provided to be usable by the user at any time, may be provided to be usable only by a service person but unusable by the user. Alternatively, the correction data setting function 301 or 302 may be utilized in the process of manufacturing the printer or the head.

The information processing apparatus 300 may be a jig usable by the service person, or may be a jig used in the process of manufacturing the printer or the head.

In the embodiments described above, a case where the information processing apparatus 300 includes the correction data setting function 301 or 302 is described; however, the printer 200 may have the correction data setting function 301 or 302. In this case, a program P for realizing the correction data setting function 301 or 302 is stored in the ROM 202 or the auxiliary storage device 204. In this case, each circuit in the correction data setting function 301 or 302 has a function for realizing each function. In addition, the head drive circuit 101 may have the correction data setting function 301 or 302.

Further, in the embodiments described above, a case in which the printer 200 has the correction data memory 220 is described; however, the head 100 may include the correction data memory 220.

The first parameter output circuit 311, the second parameter output circuit 312, the nozzle number generation circuit 313, the first register circuit 314, the second register circuit 315, the multiplication circuit 316 and the conversion circuit 317 of the correction data setting function 301, or the first parameter output circuit 311, the second parameter output circuit 312, the third parameter output circuit 331, the nozzle number generation circuit 313, the first register circuit 314, the second register circuit 315, the third register circuit 332, the multiplication circuit 316, the addition circuit 333 and the conversion circuit 317 of the correction data setting function 302 may be included in the printer 200, and directly store the output of the conversion circuit 317 in the correction data memory 220 of the printer 200. In that case, other parts of the correction data setting function 301 or the correction data setting function 302 can be omitted.

The first parameter output circuit 311, the second parameter output circuit 312, the nozzle number generation circuit 313, the first register circuit 314, the second register circuit 315, the multiplication circuit 316 and the conversion circuit 317 of the correction data setting function 301, or the first parameter output circuit 311, the second parameter output circuit 312, the third parameter output circuit 331, the nozzle number generation circuit 313, the first register circuit 314, the second register circuit 315, the third register circuit 332, the multiplication circuit 316, the addition circuit 333 and the conversion circuit 317 of the correction data setting function 302 may be included in the head drive circuit 101, and may supply the output of the conversion circuit 317 to the correction data input section of the drive signal generation section 116. In that case, other parts of the correction data setting function 301 or the correction data setting function 302, the correction data memory 220 of the printer 200, the correction data output section 111 and the shift register for correction data 115 of the head drive circuit 101 may be omitted.

In addition, in the embodiments described above, the printer using the share mode type of the head 100 is exemplified; however, it is needless to say that the correction data setting function 301 of the present invention can be applied to the printer using the head 100 of a type that the actuator is not shared by the adjacent channels.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer comprising:

an inkjet head comprising an ejection section comprising a plurality of nozzles for ejecting ink, and a plurality of drive signal generation sections configured to generate drive pulse signals applied to a plurality of actuators;

a memory storing correction data of each nozzle; and a controller adjusting the drive pulse signal according to the correction data;

wherein the correction data is calculated depending on a multiplication value of a first parameter which is calculated for correcting a density unevenness of the ink ejected from each nozzle in a group and a second parameter which is calculated for correcting differences in a change rate of the density unevenness between the groups for each group.

2. The printer according to claim 1, further comprising:

a correction data setting section, which comprises a first parameter setting section configured to set the first parameter and a second parameter setting section configured to set the second parameter, configured to calculate an adjusted value of the drive pulse signal and supply the adjusted value to a correction data input section of the drive signal generation section, wherein each of a plurality of the drive signal generation sections comprises a correction data input section for receiving the adjusted value of the drive pulse signal, respectively.

3. The printer according to claim 1, wherein the actuators comprise piezoelectric members.

4. A printer comprising:

an inkjet head comprising an ejection section comprising a plurality of nozzles for ejecting ink, and a plurality of drive signal generation sections configured to generate drive pulse signals applied to a plurality of actuators;

a memory storing correction data of each nozzle; and a controller adjusting the drive pulse signal according to the correction data;

wherein the correction data is calculated depending on an added value of a third parameter calculated for compensating an increase or a decrease in an ink density occurring between groups of nozzles and a multiplication value calculated according to a first parameter which is calculated for compensating a density unevenness of the ink ejected from each nozzle in a group and a second parameter which is calculated for compensating a difference in a change rate of the density unevenness between the groups for each group.

5. The printer according to claim 4, wherein the actuators comprise piezoelectric members.

* * * * *